US007337944B2

(12) United States Patent
Devar

(10) Patent No.: US 7,337,944 B2
(45) Date of Patent: Mar. 4, 2008

(54) UNIVERSAL DELIVERY AND COLLECTION BOX UNIT (UDCBU)

(75) Inventor: Rodney C. Devar, Alexandria, VA (US)

(73) Assignee: United States Postal Service, Washington, DC (US)

( * ) Notice: Subject to any disclaimer, the term of this patent is extended or adjusted under 35 U.S.C. 154(b) by 287 days.

(21) Appl. No.: 10/468,364

(22) PCT Filed: Feb. 20, 2002

(86) PCT No.: PCT/US02/04866

§ 371 (c)(1),
(2), (4) Date: Aug. 19, 2003

(87) PCT Pub. No.: WO02/066344

PCT Pub. Date: Aug. 29, 2002

(65) Prior Publication Data

US 2004/0074957 A1 Apr. 22, 2004

Related U.S. Application Data

(60) Provisional application No. 60/269,394, filed on Feb. 20, 2001.

(51) Int. Cl.
*A47G 29/12* (2006.01)

(52) U.S. Cl. ..... 232/19; 232/25; 232/34; 232/45; 340/569; 235/381

(58) Field of Classification Search ..... 232/17, 232/19, 24, 25, 34, 45, 35; 340/569; 235/381; 109/38

See application file for complete search history.

(56) References Cited

U.S. PATENT DOCUMENTS 472,105 A * 4/1892 Bussard ..... 232/24

(Continued)

FOREIGN PATENT DOCUMENTS

EP 0 516 898 A1 12/1992

(Continued)

OTHER PUBLICATIONS

International Search Report in PCT/US02/09870, mailed Dec. 5, 2002.

(Continued)

*Primary Examiner*—William L. Miller
(74) *Attorney, Agent, or Firm*—Finnegan, Henderson, Farabow, Garrett & Dunner, LLP

(57) ABSTRACT

The invention relates to a universal delivery and collection box unit (UDCBU). In one implementation, a UDCBU includes a mail compartment (110/120) accessible by one door (210) and a storage compartment (130) accessible by a second door (220). The mail compartment allows the postal service to deliver and pickup mail. The storage compartment allows both the postal service and authorized delivery services to deliver larger parcels. In this implementation, information would be recorded regarding access to this storage compartment and transmitted electronically to a consumer.

47 Claims, 11 Drawing Sheets

U.S. PATENT DOCUMENTS

| | | | | | |
|---|---|---|---|---|---|
| 481,772 | A * | 8/1892 | Spear | 232/25 |
| 693,770 | A | 2/1902 | Wright et al. | |
| 1,750,339 | A * | 3/1930 | Wood | 232/24 |
| 3,229,903 | A * | 1/1966 | Smith | 232/35 |
| 4,135,662 | A | 1/1979 | Dlugos | |
| 4,309,569 | A | 1/1982 | Merckle | |
| 4,574,352 | A | 3/1986 | Coppola et al. | |
| 4,725,718 | A | 2/1988 | Sansone et al. | |
| 4,727,368 | A | 2/1988 | Larson et al. | |
| 4,778,201 | A | 10/1988 | Kouno et al. | |
| 5,043,908 | A | 8/1991 | Manduley et al. | |
| 5,136,646 | A | 8/1992 | Haber et al. | |
| 5,136,647 | A | 8/1992 | Haber et al. | |
| 5,223,829 | A | 6/1993 | Watabe | |
| 5,373,561 | A | 12/1994 | Haber et al. | |
| 5,404,231 | A | 4/1995 | Bloomfield | |
| RE34,954 | E | 5/1995 | Haber et al. | |
| 5,573,178 | A * | 11/1996 | Worden | 232/24 |
| 5,638,446 | A | 6/1997 | Rubin | |
| 5,701,770 | A | 12/1997 | Cook et al. | |
| 5,710,887 | A | 1/1998 | Chelliah et al. | |
| 5,774,053 | A | 6/1998 | Porter | |
| 5,781,629 | A | 7/1998 | Haber et al. | |
| 5,870,549 | A | 2/1999 | Bobo, II | |
| 5,917,411 | A | 6/1999 | Baggarly | |
| 5,917,925 | A | 6/1999 | Moore | |
| 5,943,656 | A | 8/1999 | Crooks et al. | |
| 5,971,587 | A | 10/1999 | Kato et al. | |
| 5,979,750 | A | 11/1999 | Kindell | |
| 6,006,200 | A | 12/1999 | Boies et al. | |
| 6,028,517 | A | 2/2000 | Sansone et al. | |
| 6,035,402 | A | 3/2000 | Vaeth et al. | |
| 6,047,264 | A | 4/2000 | Fisher et al. | |
| 6,064,995 | A | 5/2000 | Sansone et al. | |
| D426,236 | S | 6/2000 | Kim et al. | |
| 6,138,910 | A | 10/2000 | Madruga | |
| 6,152,369 | A | 11/2000 | Wilz, Sr. et al. | |
| D436,963 | S | 1/2001 | Kim et al. | |
| 6,219,669 | B1 | 4/2001 | Haff et al. | |
| 6,233,565 | B1 | 5/2001 | Lewis et al. | |
| 6,243,620 | B1 | 6/2001 | Robinson et al. | |
| 6,246,925 | B1 | 6/2001 | Robinson et al. | |
| 6,259,964 | B1 | 7/2001 | Robinson et al. | |
| 6,275,154 | B1 * | 8/2001 | Bennett et al. | 340/569 |
| 6,285,991 | B1 | 9/2001 | Powar | |
| 6,289,323 | B1 | 9/2001 | Gordon et al. | |
| 6,323,782 | B1 | 11/2001 | Stephens et al. | |
| 6,347,737 | B1 | 2/2002 | Madruga | |
| 6,425,521 | B1 * | 7/2002 | Cooper | 232/34 |
| 6,442,571 | B1 | 8/2002 | Haff et al. | |
| 6,882,269 | B2 * | 4/2005 | Moreno | 340/5.73 |
| 2001/0032181 | A1 | 10/2001 | Jakstadt et al. | |
| 2002/0024438 | A1 * | 2/2002 | Roberson | 340/569 |
| 2002/0049672 | A1 | 4/2002 | Kitchen et al. | |
| 2002/0103868 | A1 * | 8/2002 | Khan | 709/206 |
| 2003/0077409 | A1 | 4/2003 | Schnell | |
| 2004/0122780 | A1 | 6/2004 | Devar | |

FOREIGN PATENT DOCUMENTS

| | | |
|---|---|---|
| WO | WO 97/12460 | 4/1997 |
| WO | WO 00/13368 | 3/2000 |
| WO | WO 01/00069 A2 | 1/2001 |
| WO | WO 01/18718 A1 | 3/2001 |
| WO | WO 01/65444 A1 | 9/2001 |
| WO | WO 01/99005 A1 | 12/2001 |
| WO | WO 01/99009 A2 | 12/2001 |
| WO | WO 01/99037 A1 | 12/2001 |
| WO | WO 02/08961 A1 | 1/2002 |
| WO | WO 02/21315 A1 | 3/2002 |
| WO | WO 02/079947 | 10/2002 |
| WO | WO03/023677 A1 | 3/2003 |

OTHER PUBLICATIONS

Written Opinion in PCT/US02/09870, mailed Mar. 6, 2003.

International Search Report in PCT/US 00/27068, mailed Apr. 5, 2001.

International Preliminary Examination Report in PCT/US01/08487, mailed Jan. 23, 2002.

International Preliminary Examination Report in PCT/US01/08488, mailed Jun. 11, 2003.

Written Opinion in PCT/US01/08488, mailed Oct. 28, 2002.

International Search Report in PCT/US 01/08490, mailed Jan. 22, 2002.

International Search Report in PCT/US01/19384, mailed Nov. 16, 2001.

International Preliminary Examination Report in PCT/US 01/19384, mailed Jan. 17, 2003.

Written Opinion in PCT/US 01/19384, mailed Jun. 17, 2002.

International Search Report in PCT/US 01/19421, mailed Nov. 19, 2001.

International Preliminary Examination Report in PCT/US01/19421, mailed May 16, 2002.

International Search Report in PCT/US01/23177, mailed Jul. 24, 2001.

International Preliminary Examination Report in PCT/US01/23177, mailed May 3, 2002.

International Search Report in PCT/US/0127690, mailed Nov. 19, 2001.

International Search Report in PCT/US01/28001, mailed Dec. 21, 2001.

International Preliminary Examination Report in PCT/US01/28001, mailed Aug 8, 2002.

International Search Report in PCT/US02/04866, mailed May 23, 2002.

International Preliminary Examination Report in PCT/US02/04866, mailed Oct. 6, 2003.

Written Opinion in PCT/US02/04866, mailed May 23, 2003.

Article 34 Amendments, Letter Accompanying Replacement Sheets, "Systems and Methods for Electronic Message Content," International Filing No. PCT/US01/19698, dated Jun. 20, 2001.

"CONNECT announces OneServer interactive online application platform," Business Wire, Apr. 10, 1995, p. 4101043, retrieved from DIALOG, DIALOG No. 07797909.

"Joint Direct Bill Payment Form Mich. Utilities," Bank Technology News, Apr. 1994, p. 8, retrieved from DIALOG, DIALOG No. 03302326.

"Recommendation F .400/X.400 message handling and directory services—operation and definition of service," Nov. 14, 1988, CCITT, Melbourne, XP002186347.

Bartholomew, D., "The Future of Snail Mail: The Postal Service Is Gearing up for Competition, but Can it Deliver?," Dialog Search, Information Week, No. 556, pp. 34-36, (Dec. 1995).

Newkirk, K.M., "Banks can slice transaction costs," Independent Banker, Dec. 1995, vol. 45, No. 12, pp. 52-53, retrieved fro DIALOG, DIALOG No. 00276769.

Czemy, Customer account management system for STEWEAG key accounts, Electricity Distribution, Par 1, Contributions, 14th International Conference and Exhibition (IEE Conf. Publ. No. 438), vol. 5, 1997, pp. 6/1-6/5.

Stafford et al., Delivering marketing expertise to the front lines, Expert, IEEE, vol. 9, Issue 2, 1994, pp. 23-32.

Bhushan et al., Federated accounting: service charging and billing in a business-to-business environment, Integrated Network Mangement Proceedings, 2001 IEEE/IFIP International Symposium on, May 14-18, 2001, pp. 107-121.

FedEx eBusiness Tools online feature, Fed/ex® Ship Manager Software.

FedEx, Customer Service, Fast Facts online service feature, dated Oct. 11, 2000.

Appendix K—USPS Burke Test Site Report, "User Interface Review Of Mail Item Retrieval System," Burke Station, Burke Virginia, Dec. 24, 1998.

Appendix L, In-plant Test Report, "Mail Item Retrieval System", Re-Test Date: Oct. 21, 1998.

Appendix M—Heuristic Evaluation Of The USPS Item Retrieval System Early Prototype, by Ronald B. Hoffman and Eric A. Nelson.

Campbell et al., "Methods and Systems for Proofing Identities Using a Certificate Authority," Pending U.S. Appl. No. 09/809,325, filed Mar. 16, 2001.

Campbell et al., "Methods and Systems for Providing an Electronic Account to a Customer," Pending U.S. Appl. No. 09/809,581, filed Mar. 16, 2001.

Cook et al., "Methods and Systems for Linking an Electronic Address to a Physical Address of a Customer," Pending U.S. Appl. No. 09/809,326, filed Mar. 16, 2001.

Cook et al., "Methods and Systems for Providing a Secure Electronic Mailbox," Pending U.S. Appl. No. 09/809,312, filed Mar. 16, 2001.

Orbke et al., "Methods and Systems for Establishing an Electronic Account to a Customer," Pending U.S. Appl. No. 09/809,328, filed Mar. 16, 2001.

Cambell, "Systems and Methods for Providing Electronic Archiving," Provisional U.S. Appl. No. 60/231,337, Application filed Sep. 8, 2000.

* cited by examiner 505
510

505
510
511

515
520

515
520

530
525

530
531
525

535
540

535
541
540
542

550

545
545
550

560
555

555
561
560
562

565
570

565
570
571

UNIVERSAL DELIVERY AND COLLECTION BOX UNIT (UDCBU)

CROSS-REFERENCE TO RELATED APPLICATION

This application claims the benefit of U.S. Provisional Application No. 60/269,394, filed Feb. 20, 2001, titled UNIVERSAL DELIVERY AND COLLECTION BOX UNIT (UDCBU) a/k/a THE MILLENNIUM MAILBOX, the disclosure of which is expressly incorporated herein by reference.

BACKGROUND OF THE INVENTION

Currently, an increasing amount of commerce involves the home delivery of merchandise. In particular, the advent of catalogs and the Internet as low cost marketing and distribution channels for goods and services have greatly increased the amount of commerce involving the home delivery of goods. Companies involved in delivering goods to consumers, however, have experienced difficulty in meeting consumers' price, service, security, privacy, selection, and information expectations. One cause of this difficulty is the limitations imposed on delivery service by current delivery and collection units or mailboxes.

Presently, the typical collection unit is a small box located on the curb in front of a consumer's house. This box provides adequate storage for small pieces of mail, but cannot accommodate larger packages. Further, other delivery services besides the United States Postal Service (USPS), cannot utilize these mailboxes. This often necessitates the use of a more expensive form of delivery, which in turn increases the delivery costs to the consumer.

In addition, the limitations imposed by typical collection units often interfere with consumers' desire for consistent delivery service. Because many packages cannot fit in typical mail collection units, these packages usually require personal delivery. If a consumer is not home to receive a package, however, the package is often handled inconsistently. In some cases, the consumer may receive a notice of attempted delivery. In other cases, the merchandise may be placed beside the front door. In still other cases, the merchandise is left with a neighbor. This inconsistent approach often leads to consumer dissatisfaction.

These same problems also exist with respect to consumers' desire for security and privacy. When packages are left at their front door or with neighbors, consumers are often concerned about theft and damage to their goods. Consumers also tend to dislike the loss of privacy associated with having their packages left with their neighbors. Moreover, consumers are often concerned about the signal that packages left in front of their homes send to home burglars. Additionally, typical collection units provide no way of preventing access to even those pieces of mail that fit in the collection unit.

In addition, consumers often want the ability to choose when and where their direct purchases will be received. However, as stated above, these deliveries often require that the consumer be home. This is not often practical for many consumers. This prevents the delivery of many items, such as perishables.

Finally, consumers, merchants, and delivery service providers expect that delivery information will be captured and made available between all parties from the point at which an order is made to the time it is delivered. The currently available collection units, however, are not currently used to transmit delivery information. With the exception of the outgoing mail flag found on some collection units, most collection units are not able to receive or transmit any information regarding what items are in the collection unit, when an item was placed in the collection unit, or who placed the items in the collection unit.

Therefore, it is desirable to provide a collection unit that solves some or all of the problems associated with currently available systems.

SUMMARY OF THE INVENTION

Structures in accordance with an embodiment of the invention provide a secure container for housing mail and other deliverables. The container comprises a watertight housing, an incoming mail compartment disposed inside the housing, an outgoing mail compartment disposed inside the housing, a storage compartment disposed inside the housing, a main door attached to the housing, a storage door attached to the housing, and a sensing device. The main door provides access to the incoming mail compartment and the outgoing mail compartment. The storage door provides access to the storage compartment. The sensing device is configured to determine delivery information upon placement of a deliverable in the storage compartment.

Structures in accordance with another embodiment of the invention provide a secure container for housing mail and other deliverables comprising a watertight housing, an incoming mail compartment located inside the housing, an outgoing mail compartment located inside the housing, an auxiliary mail compartment located inside the housing, a storage compartment located inside the housing, a main door attached to the housing, and a storage door attached to the housing. The auxiliary compartment is configured to accept mail having a configuration such that it cannot be delivered to the incoming mail compartment. The main door provides access to the incoming mail compartment, the outgoing mail compartment, and the auxiliary mail compartment. The main door also comprises a locking mechanism, which allows only the United States Postal Service and an authorized consumer to open the main door. The storage door provides access to the storage compartment. The storage door also comprises a locking mechanism, which allows only the United States Postal Service, an authorized consumer, and an authorized source of deliveries to open the storage door.

Systems in accordance with another embodiment of the invention provide a system for receiving deliverables and communicating delivery information to an intended recipient. The system comprises a receptacle configured to receive deliverables. The receptacle includes a first compartment for receiving postal deliverables and a second compartment for receiving deliverables from authorized non-postal sources. The system also comprises means for sensing when non-postal deliverables are received in the second compartment and for identifying associated delivery information; and means for electronically storing the delivery information and transmitting the delivery information to a designated location.

Methods in accordance with another embodiment of the invention provide a method for monitoring delivery of items to a plurality of receptacles at different locations. The method comprises providing a secure receptacle to a plurality of consumers. The secure receptacle includes at least two secured storage compartments configured to accept delivered items. At least one secured storage compartment is configured to receive postal deliverables and at least one storage compartment is configured to receive deliverables from authorized non-postal sources. The method also comprises authorizing at least one non-postal source of deliverable items to have access to the non-postal storage compartments of each receptacle, monitoring usage of the secured non-postal storage compartment to identify when a delivered item has been received and identifying the authorized source of the delivered item, and assessing a fee against the authorized source.

Systems in accordance with another embodiment of the invention provide a system for receiving deliverables comprising a receptacle configured to receive deliverables. The receptacle includes a first compartment for receiving postal deliverables and a second compartment for receiving deliverables from authorized non-postal sources. The system also includes means for sensing when non-postal deliverables are received in the second compartment and for identifying associated delivery information and means for electronically storing the delivery information.

Additional aspects of the invention are disclosed and defined by the appended claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

In the drawings.

DESCRIPTION OF THE EMBODIMENTS

Figure 1:
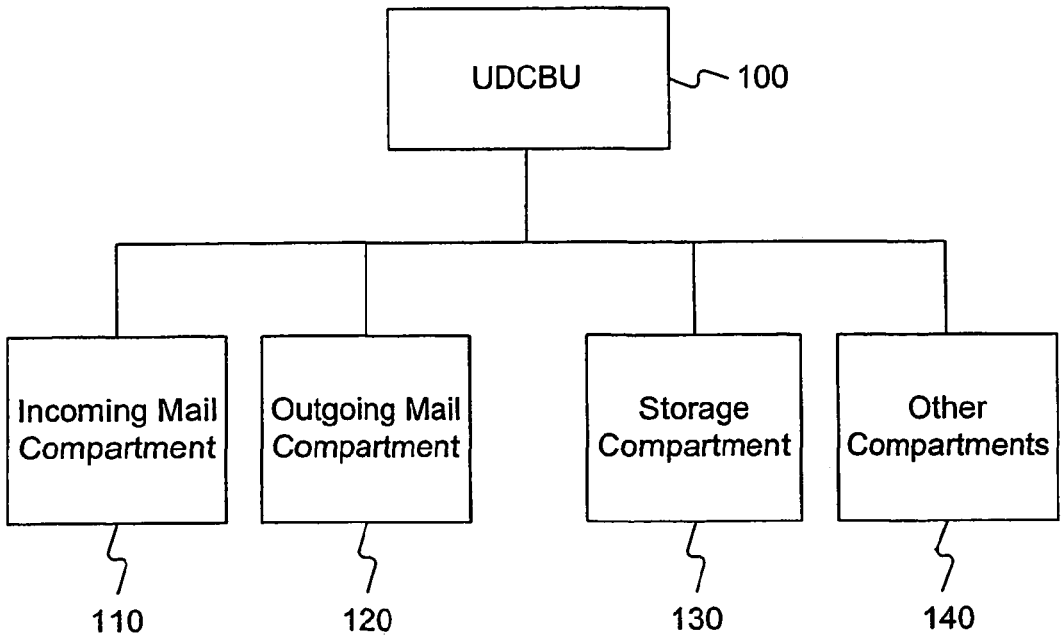
FIG. 1 is a block diagram illustrating the components of a universal delivery and collection box unit consistent with an embodiment of the invention.
Figure 2:
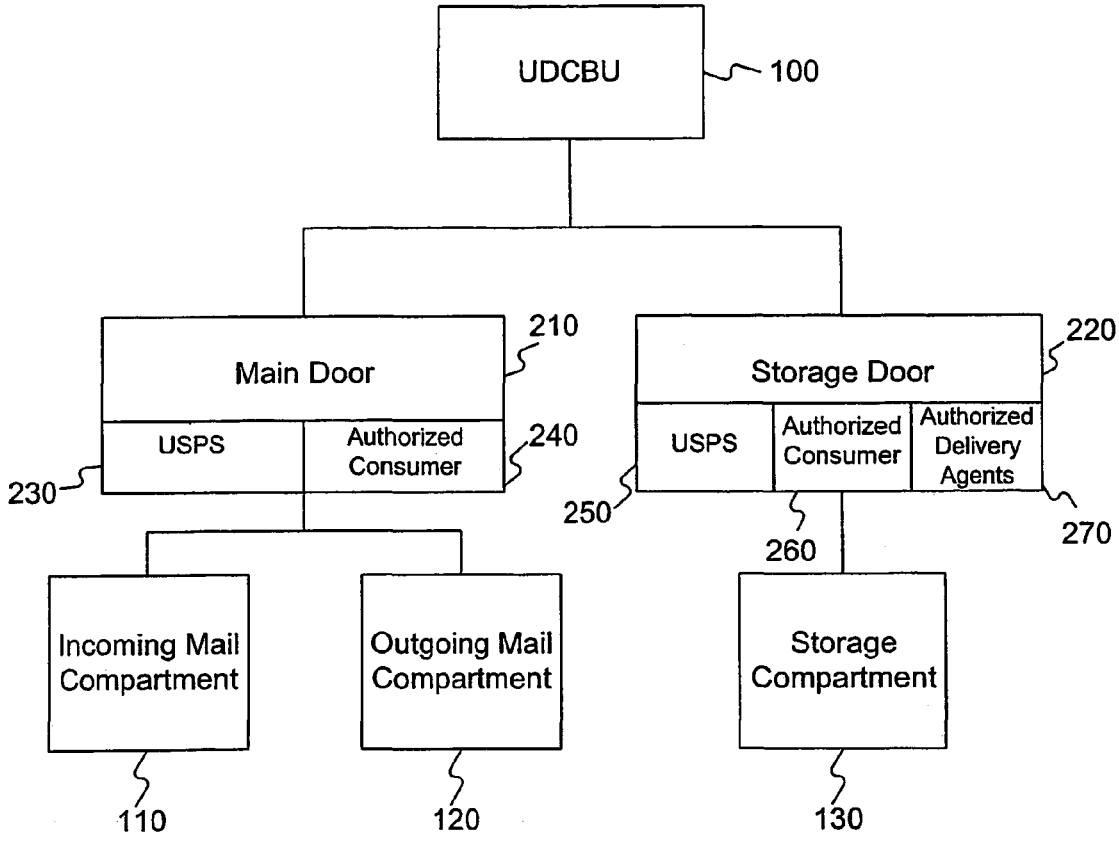
FIG. 2 is a block diagram illustrating the door components of a universal delivery and collection box unit consistent with an embodiment of the invention.
Figure 3:
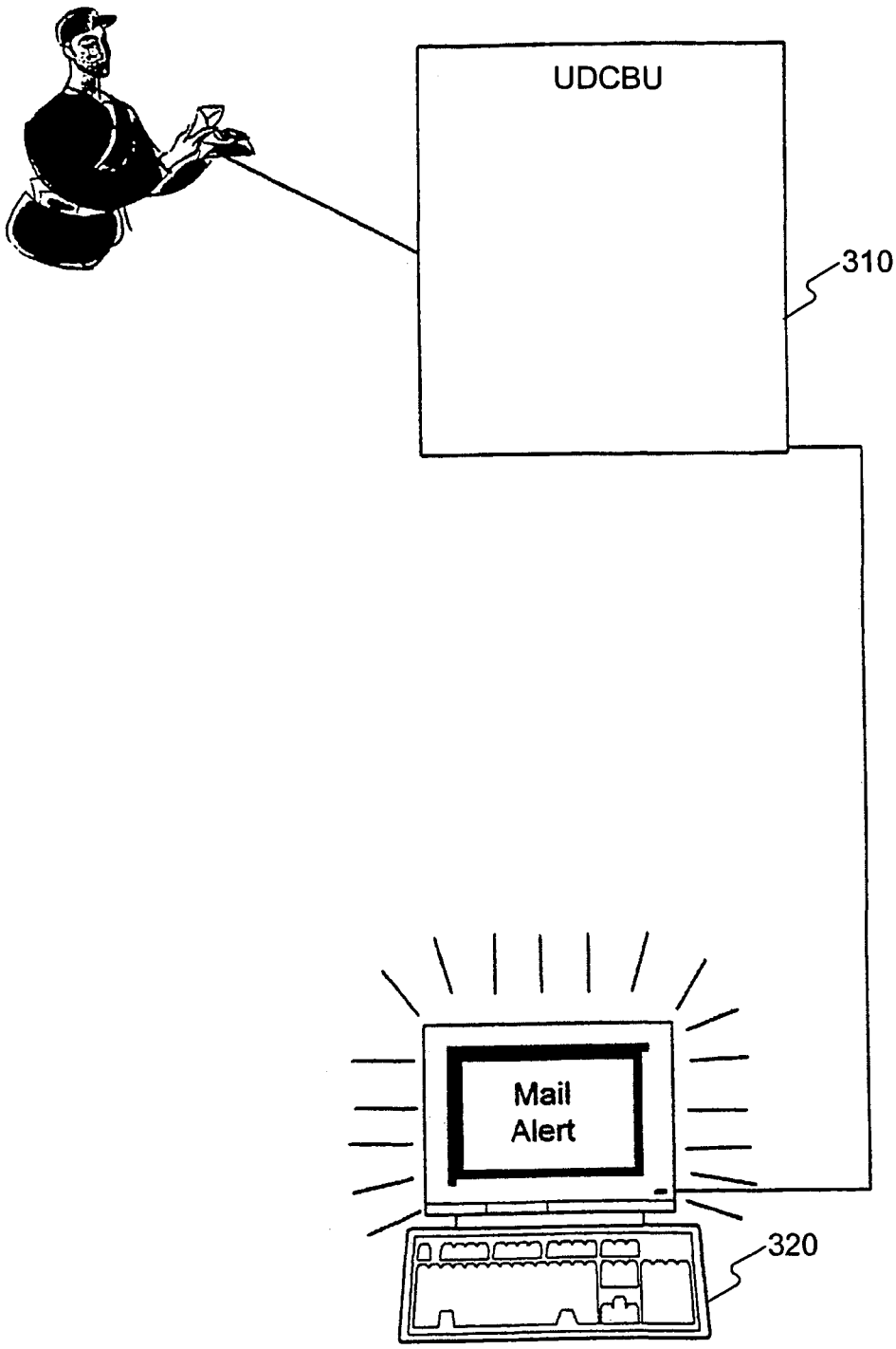
FIG. 3 is a flow diagram illustrating the transfer of mail delivery information from a universal delivery and collection box unit consistent with an embodiment of the invention.

Structures in accordance with the present invention will now be described with respect to an exemplary embodiment of a universal delivery and collection box unit ("UDCBU") or Omnibox. FIGS. 1-3 describe the components of a UDCBU consistent with the invention. FIGS. 4-8 describe one embodiment of a UDCBU comprising these components. This embodiment is merely exemplary, and other embodiments may also be used.

FIG. 1 is a block diagram illustrating the components of a universal delivery and collection box unit consistent with an embodiment of the invention. As shown in FIG. 1, in one implementation, the Universal Delivery and Collection Box Unit (UDCBU) 100 includes four components: an incoming mail compartment 110, an outgoing mail compartment 120, a storage compartment 130, and other compartments 140. This implementation is merely exemplary, and other implementations may also be used. Of course, fewer or more compartments may be utilized.

Incoming mail compartment 110 holds mail delivered by the USPS to an authorized consumer. Outgoing mail compartment 120 holds mail placed in UDCBU 100 by the authorized consumer to be picked up for delivery by USPS. Storage compartment 130 holds parcels that either cannot fit in the incoming mail compartment or are delivered by authorized entities other than USPS. For example, groceries, dry cleaning, videos, office supplies, hot/cold meals, and pharmaceutical items may be placed in storage compartment 130. Storage compartment may also be used to return goods. Other compartments 140 include additional compartments that may be contained in UDCBU 100. In one implementation, other compartments 140 includes a compartment to hold mail that has a configuration such that it cannot be delivered to the incoming mail compartment, such a newspapers. These compartments allow UDCBU 100 to hold both regular United States mail, similar to existing collection units, and parcels delivered by other services. This implementation is merely exemplary, and other implementations may also be used.

FIG. 2 is a block diagram illustrating the door components of a universal delivery and collection box unit consistent with an embodiment of the invention. As shown in FIG. 2, in one implementation, UDCBU 100 includes two doors: a main door 210 and a storage door 220. In this implementation, main door 210 provides access to incoming mail compartment 110 and outgoing mail compartment 120, and storage door 220 provides access to storage compartment 130. The use of separate doors for incoming and outgoing mail compartments 110 and 120 and for storage compartment 130 allows for different levels of accessibility for those compartments.

For example, as shown in FIG. 2, in one implementation, main door 210 would be accessible only by USPS 230 and an authorized consumer 240. Authorized consumer 240 would be an individual or group of individuals (e.g., a family living together) authorized to receive mail at UDCBU 100. This would allow USPS 230 to deliver and pick up mail from the UDCBU, and authorized consumer 240 to retrieve incoming mail and leave outgoing mail for pickup in UDCBU 100. However, it restricts access by other individuals, thereby providing greater security for mail delivery. In this implementation, a locking mechanism may be used to restrict access to USPS 230 and authorized consumer 240. This locking mechanism may be mechanical, such as a key lock, electrical, such as a keypad, or any other locking mechanism. This implementation is merely exemplary, and other implementations may also be used.

As further shown in FIG. 2, in one implementation, storage door 220 would be accessible by USPS 250, an authorized consumer 260, and authorized delivery agents 270. Authorized consumer 260 would be an individual authorized to receive mail at UDCBU 100. This would allow USPS 250 to place parcels that will not fit in incoming mail compartment 110 or other compartment 140, into storage compartment 130. This will also allow authorized delivery agents 270 to leave a package for authorized consumer 260 in a secure location if authorized consumer 260 is not available to accept the package. In one implementation, upon a request by authorized consumer 260, USPS 250 would provide authorized delivery agents 270 with a key or other access information to open storage door 220. In addition, authorized consumer 260 would be able to open storage door 220 to retrieve packages. In this implementation, a locking mechanism may be used to restrict access to storage compartment 130 to USPS 250, authorized consumer 260, and authorized delivery agents 270. This locking mechanism may be mechanical, such as a key lock, electrical, such as a keypad, or any other locking mechanism. These implementations are merely exemplary, and other implementations may also be used.

FIG. 3 is a flow diagram illustrating the transfer of mail delivery information from a universal delivery and collection box unit consistent with an embodiment of the invention. As shown in FIG. 3, upon delivery of a package, UDCBU 310 may record information regarding the delivery of parcels to a compartment (such as storage compartment 130 described in FIG. 1) in UDCBU 310. Delivery information may include when the storage compartment is accessed, who accessed the storage compartment, as well as any other delivery information. As described in FIG. 2, a door of UDCBU 310 (such as storage door 220 in FIG. 2) may be locked electronically. In this implementation, the use of a keypad requiring an access code to open the door would allow UDCBU 310 to record delivery information. Each delivery service that accesses the box would be assigned a unique access code. UDCBU 310 would then be able to record who accessed UDCBU 310 and when the access occurred. This information may be stored locally or remotely.

As shown in FIG. 3, this information may then be transmitted to a number of different locations, such as a computer 320. This information may also be transmitted to a pager, a cell phone, a database, or any other device. A database may be used to store information regarding all access to UDCBU 310 over a give time period. This information may be used for both security purposes and to calculate the number of times UDCBU 310 is accessed by delivery agents for accounting purposes. In one implementation, this information would be transmitted using wireless technology.

In another implementation, a reader, such as an infrared scanner, would retrieve all the access information from UDCBU 310. The mail carrier would then dock the reader with a computer station, which would then transmit the delivery information to the central data source. From this data source, the information could be transmitted to a variety of sources, as discussed in FIG. 3.

The storage of this information would allow USPS to charge authorized delivery agents an access fee for using UDCBU 400. In this implementation, an authorized delivery agent would register with the USPS for access to UDCBUs. Every time a customer of that authorized delivery agent requests delivery of a parcel, the delivery agent would request an access code for the designated UDCBU. The delivery agent would enter the access code and leave the parcel in the UDCBU. A sensing means would record when the delivery agent accessed the UDCBU and who accessed the UDCBU. This process would be repeated at every UDCBU that the authorized delivery agent accessed. The USPS would then compile a record of all the times that delivery agent accessed a UDCBU. The USPS could then charge a per usage fee based on the access. Alternatively, the fee could be charged for unlimited access over a period of time, such as a monthly access fee. These implementations are merely exemplary, and other implementations may also be used.

FIGS. 1-3 illustrate the components of a UDCBU. FIGS. 4-8 illustrate one implementation of a universal delivery and collection box unit comprising these components. This implementation is merely exemplary, and other implementations may also be used.

Figure 4A:
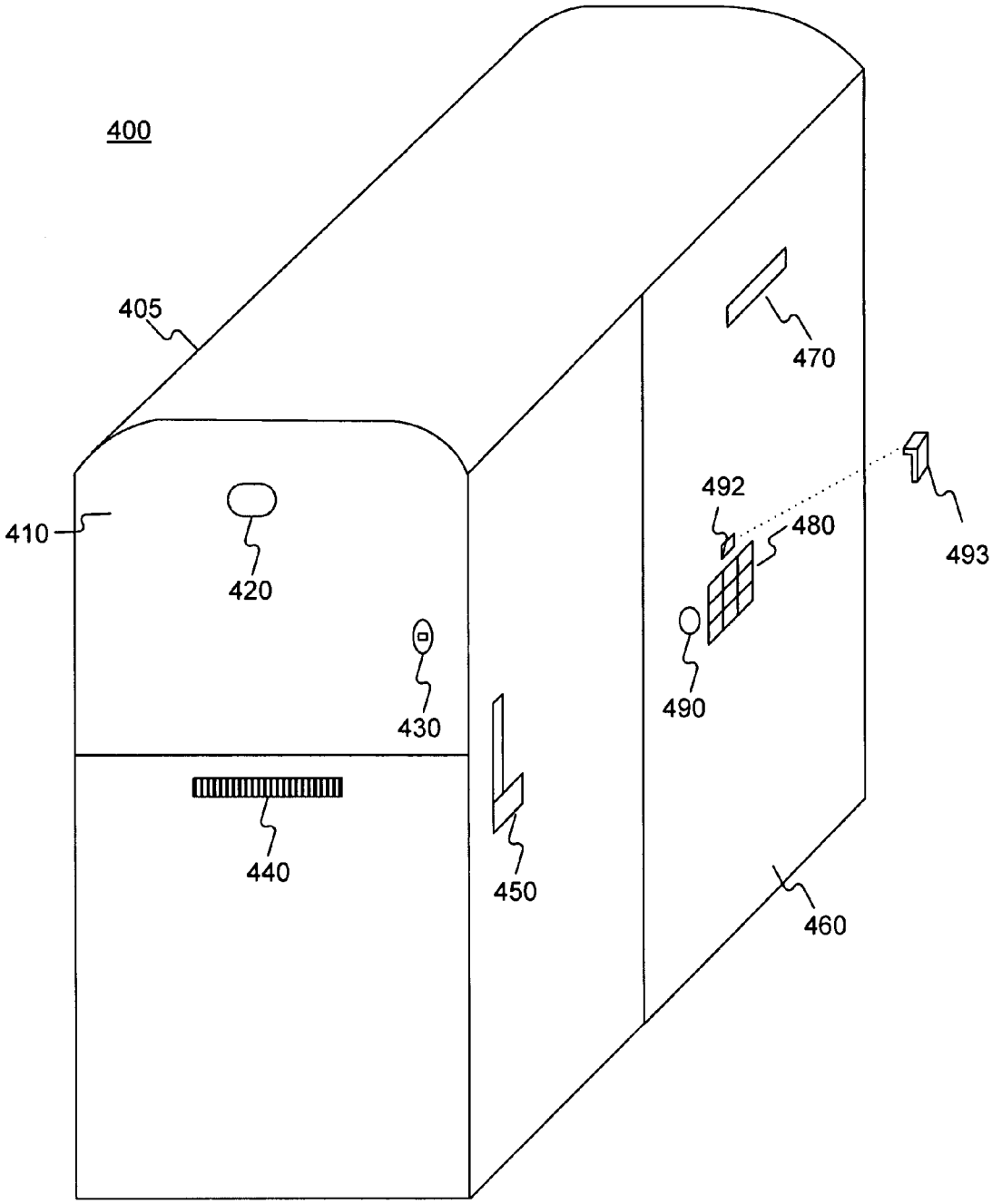
FIG. 4A is a frontal perspective view of a universal delivery and collection box unit consistent with an exemplary embodiment of the invention.

FIG. 4 is a frontal perspective view of a universal delivery and collection box unit consistent with an exemplary embodiment of the invention. As shown in FIG. 4, a UDCBU 400 comprises a housing 405, a main door 410, and a storage door 460. Housing 405, main door 410, and storage door 460 may be constructed of any material consistent with the invention. As shown in FIG. 4, in this implementation, main door 410 is attached to a front face of housing 405, and storage door 460 is attached to a side face of housing 405. In one implementation, housing 405, main door 410, and storage door 460 may be tamper resistant, watertight, and weatherproof. These implementations are merely exemplary, and other implementations may also be used.

In one implementation, all exterior surfaces of UDCBU 400, including the rear and bottom, will have a smooth finish and be impact resistant. In this implementation, sufficient impact resistance will require that the coating applied to any exposed surface of the unit will not be cracked, chipped, broken, or dented more than 1/16 inch in depth, by dropping a 2-pound hard steel ball with a ½-inch spherical radius from a height of 6 inches on any surface of the unit. In this implementation, the impact strength of housing 405 will exceed 500 inch-pounds from −40 to 145±5° F. In addition, housing 405 shall endure impact from a baseball bat or blunt instrument delivered by an individual of normal size and stature on any surface of the unit without allowing access to any compartment or receptacle by springing or breaking any door open as a result of the impact. These implementations are merely exemplary, and other implementations may be used.

In this implementation, main door 410 and storage door 460 will be sturdy and able to withstand loads at any point on the exposed surface and in any direction without permanent deformation or failure, which would allow unauthorized entry into the compartment. In this implementation, main door 410 shall withstand inward and outward pulls of 250±5 pounds anywhere on the outside surface of the door when in the locked or closed position, and storage door 460 shall withstand inward or outward pull of 500±5 pounds anywhere on the exposed surface of the door when in a locked position.

In one implementation, as shown in FIG. 4, main door 410 comprises a handle 420 and a locking mechanism 430. Handle 420 allows an individual to open main door 410. In one implementation, handle 420 is located at a height sufficient for a delivery person to comfortably reach the handle from within a delivery vehicle. In this implementation, main door 410 will operate by pulling outward and downward on handle 420. Other implementations of handle 420 are described in FIGS. 5A-5N.

In addition, in this implementation, main door 410 will be designed to provide protection against wind, rain, sleet, or snow. In another implementation, door latches (not shown) will hold the door closed but allow easy opening and closing requiring no more than 5 pounds of force. In another implementation, magnetic latches will be used. In yet another implementation, carriers are alerted that main door 410 is properly shut by either tactile or by sound (i.e., "snap" or "click"). In another implementation, the door, once opened, will remain in the open position until the carrier pushes it closed. In this implementation, the door will rotate a minimum of 100 degrees and a maximum of 120 degrees. These implementations are merely exemplary, and other implementations may be used.

Locking mechanism 430 prevents unauthorized individuals from opening main door 410. Locking mechanism 430 may be an electrical or mechanical lock. In one implementation, locking mechanism 430 would be a standard key operated lock. In another implementation, locking mechanism 430 would comprise a keypad requiring an access code to open main door 410. In still another implementation, locking mechanism 430 could be operated by a smart card that would be inserted or swiped to allow an individual to open main door 410. As described in FIG. 2, in this implementation, lock 430 would allow only the USPS and an authorized consumer to open main door 410. These implementations are merely exemplary, and other implementations may also be used.

As shown in FIG. 4, storage door 460 comprises a handle 490, a locking mechanism 480, and a deliverables indicator 470. Storage door 460 will be designed to hinder tampering and forced entries. In one implementation, storage door 460 will have a seal to ensure the compartment is air tight and waterproof. These implementations are merely exemplary, and other implementations may also be used.

Handle 490 allows an individual to open storage door 460. In one implementation, when unlocked, a force, no greater than 5 lbs. on handle 490 will open storage door 460. In this implementation, storage door 460 will operate freely but be sturdy enough to resist bending that may result from a forced entry attempt.

Locking mechanism 480 prevents unauthorized individuals from opening storage door 460. Locking mechanism 480 may be an electrical or mechanical lock. In one implementation, locking mechanism 480 would be a standard key operated lock. In another implementation, locking mechanism 480 could be operated by a smart card that would be inserted or swiped to allow an individual to open storage door 460.

In another implementation, as shown in FIG. 4, locking mechanism 480 is operated by an access entry control mechanism, such as a keypad. The keypad would allow authorized individuals to enter an access code to open storage door 460. A battery may be used to power the locking mechanism 480. In this implementation, an authorized consumer is assigned a fixed access code that will always allow the user to open storage door 460. A second access code would also be assigned for authorized delivery personnel. In one implementation, this second access code would change daily in a random or pseudo-random fashion and would be made available to delivery personnel at the time of delivery. It is contemplated that different authorized delivery personnel would have different access codes.

In this implementation, a sensing device would record the time at which an individual entered an access code and the access code entered. This information would be stored in the unit. A communications device 492 would then communicate this information to a designated location. In one implementation, UDCBU 400 would comprise a wireless transmitter to transmit the data to a central data location. In another implementation, device 492 would be scanned with an infrared reader 493 by a mail carrier. Reader 493 would retrieve all the access information from UDCBU 400.

Figure 4B:
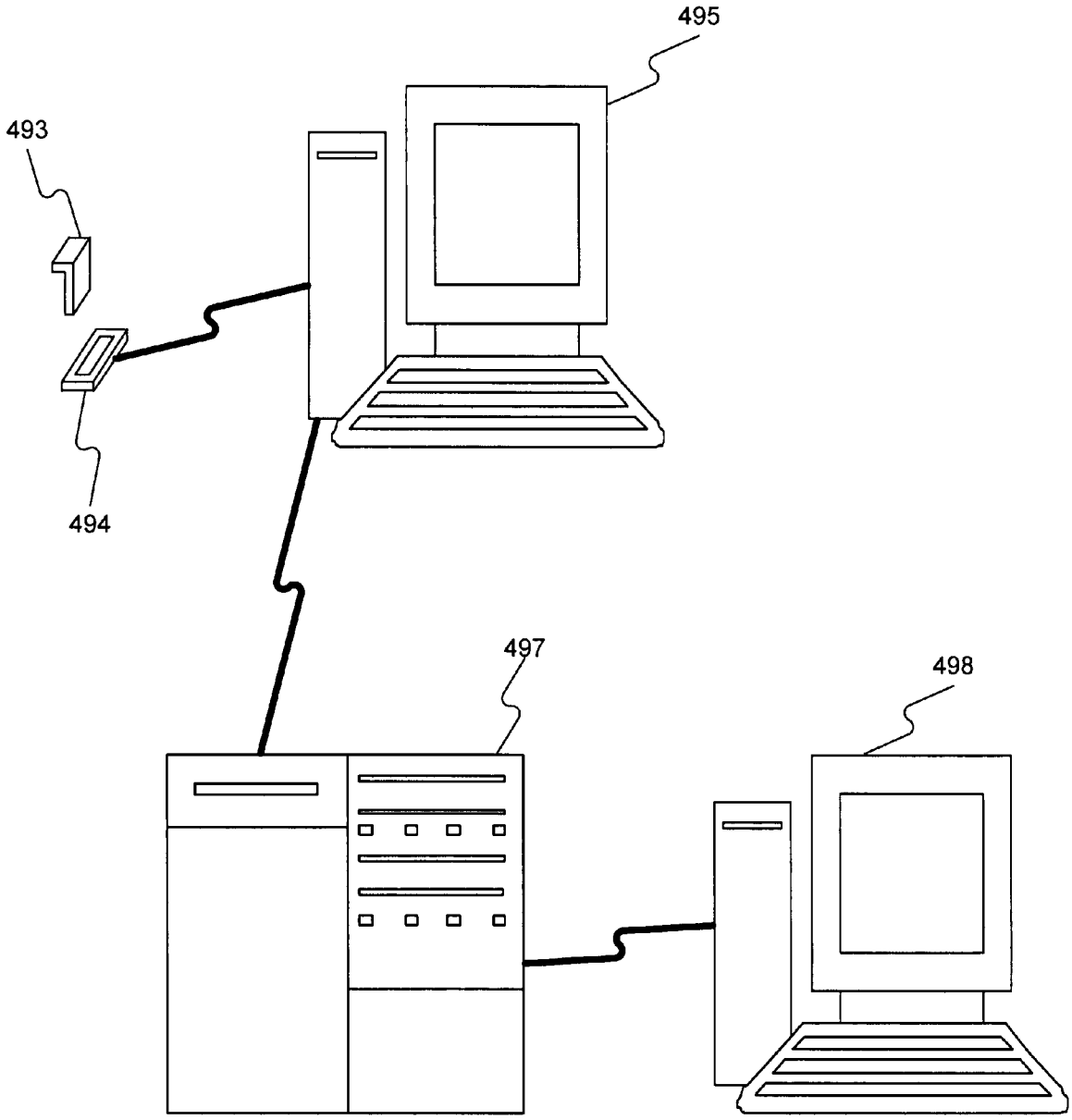
FIG. 4B illustrates a computer station for docking a reader with a computer station and communicating with a central data source consistent with an exemplary embodiment of the invention.

FIG. 4B illustrates a computer station for docking a reader with a computer station and communicating with a central data source consistent with an exemplary embodiment of the invention. In one implementation, after reader 493 retrieves the access information from UDCBU 400 as described above, the mail carrier would then dock reader 493 with a computer station 495 using a docking station 494. Computer station 495 would then transmit the delivery information to a central data source 497. Central data source 497 would be used to store the access information from UDCBU 400. From this data source, the information could be transmitted to a variety of sources, as discussed in FIG. 3. In one implementation, a computer station 498 would have access to the data stored in central data source 497. As described above with reference to FIG. 3, in one implementation, computer station 498 would sort the delivery information for UDCBU 400 based on the identity of the source of any non-postal deliverables delivered to storage compartment 810 (not shown in FIG. 4, but shown in FIG. 8). Computer station 498 would then be used to calculate an access fee based on the number of times the source of the non-postal deliverables in storage compartment 810. It should be noted that the information may be transmitted between the docking station 494, computer station 495, central data source 497 and computer station 498 by wires or wirelessly. These implementations are merely exemplary, and other implementations may also be used.

Figure 8:
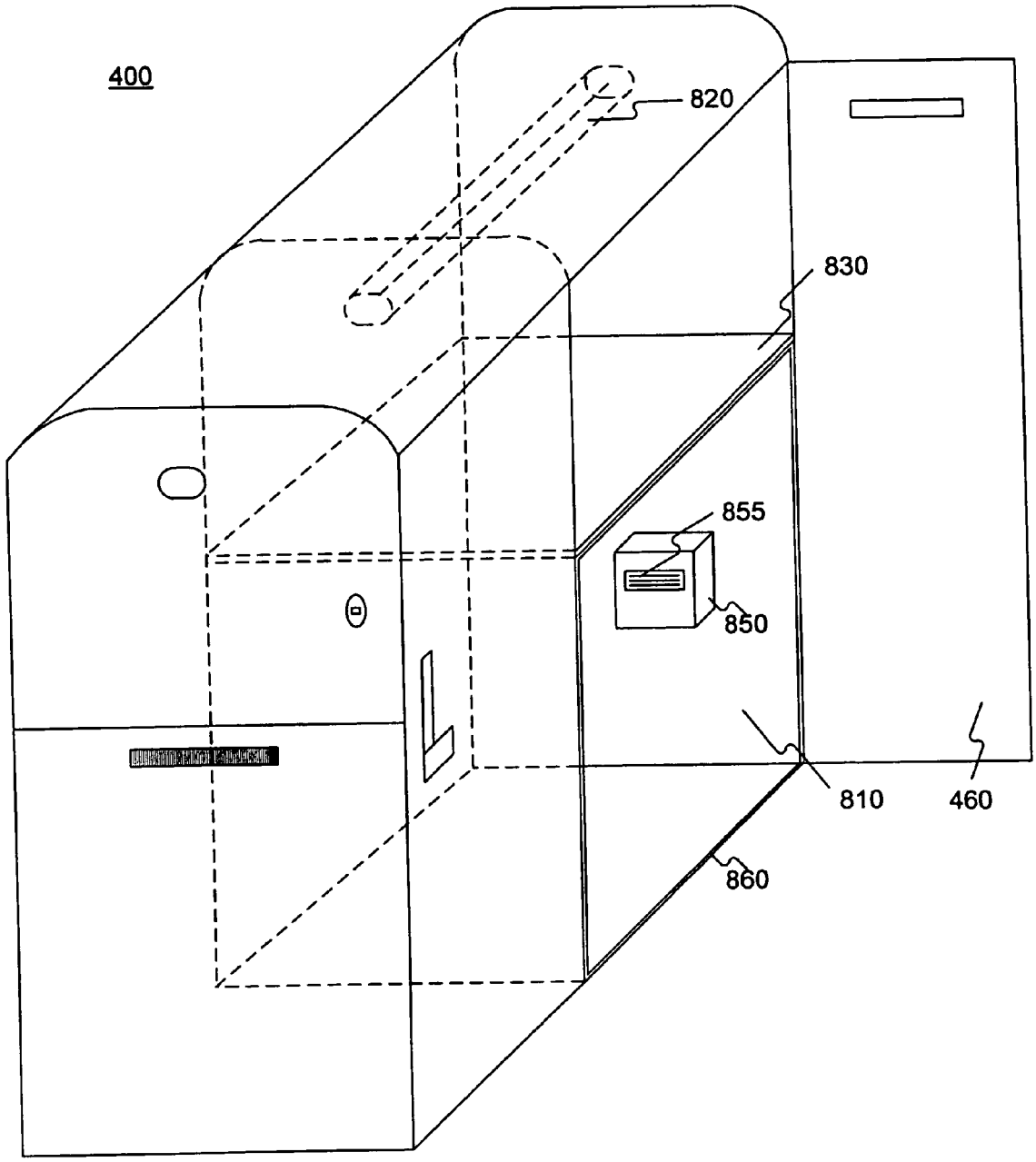
FIG. 8 is a frontal perspective view illustrating a universal delivery and collection box unit with an open storage door consistent with an exemplary embodiment of the invention, as shown in FIG. 4.

Deliverables indicator 470 indicates the presence of a deliverable in storage compartment 810 (not shown in FIG. 4, but shown in FIG. 8). In one implementation, deliverables indicator 470 may include a slot in storage door 460 with a bi-directional sliding mechanism (not shown) located behind storage door 460. In this implementation, deliverables indicator 470 would comprise two panels: one indicating the presence of deliverables and one indicating the absence of deliverables. The bi-directional sliding mechanism would move deliverables indicator 470 back and forth in front of the slot to place the appropriate panel of deliverables indicator 470 in front of the slot. This would allow an individual in front of storage door 460 to see one of the panels of deliverables indicator 470 and determine if a parcel is present in storage compartment 810. In another implementation, deliverables indicator 470 may operate automatically. For example, the opening of storage door 460 could act to operate deliverables indicator 470. These implementations are merely exemplary, and other implementations may also be used.

As shown in FIG. 4, UDCBU also comprises an outgoing mail flag 450 and a bar code 440. Outgoing mail flag 450 indicates the presence of mail in an outgoing mail compartment 710 (not shown in FIG. 4, but shown in FIGS. 7A-7C). In this implementation, outgoing mail flag 450 is located on a side face of housing 405. In another implementation, outgoing mail flag 450 would have two orientations. The first orientation would indicate the presence of mail in outgoing mail compartment 710; the second orientation would indicate the absence of mail in outgoing mail compartment 710. In this implementation, an authorized consumer could manually move outgoing mail flag 450 to the first orientation upon placing mail in outgoing mail compartment 710, and a mail carrier could manually move the outgoing mail flag 450 to the second position upon removing the mail from outgoing mail compartment 710. In another implementation, outgoing mail flag 450 would automatically move to the second position upon opening main door 410. Other implementations of outgoing mail flag 450 are described in FIGS. 6A-6C. These implementations are merely exemplary, and other implementations may also be used.

Bar code 440 allows USPS to confirm delivery of mail and packages to UDCBU 400. In one implementation, each UDCBU 400 would be assigned a specific identification number, which would be represented by bar code 440. Currently, delivery confirmation barcodes are placed on most mail pieces for which delivery confirmation is requested. These barcode labels can be printed by the shipper, a vendor, or by the Postal Service. Using a Mobile Data Collection Device (MDCD) scanning device, the carrier may scan the delivery confirmation barcode on the mail piece and barcode 440 to confirm delivery of the mail piece. After completing his route, the carrier will place the MDCD in a cradle located at a delivery unit. The cradle transmits the information from the MDCD to a central data location. USPS and its customers can then retrieve this information via the Internet or other methods. This implementation is merely exemplary, and other implementations may also be used.

In another implementation, UDCBU 400 also includes a power source. The power source would be used to provide power to any electronic locking mechanisms or other devices located in UDCBU that require power. In one implementation, this power source is a battery. In another implementation, UDCBU 400 is wired directly to an electricity source, such as from a house. These implementations are merely exemplary, and other implementations may also be used.

Figures 5A, 5B, 5C, 5D, 5E, 5F, 5G, 5H, 5I, 5J, 5K, 5L, 5M, 5N:
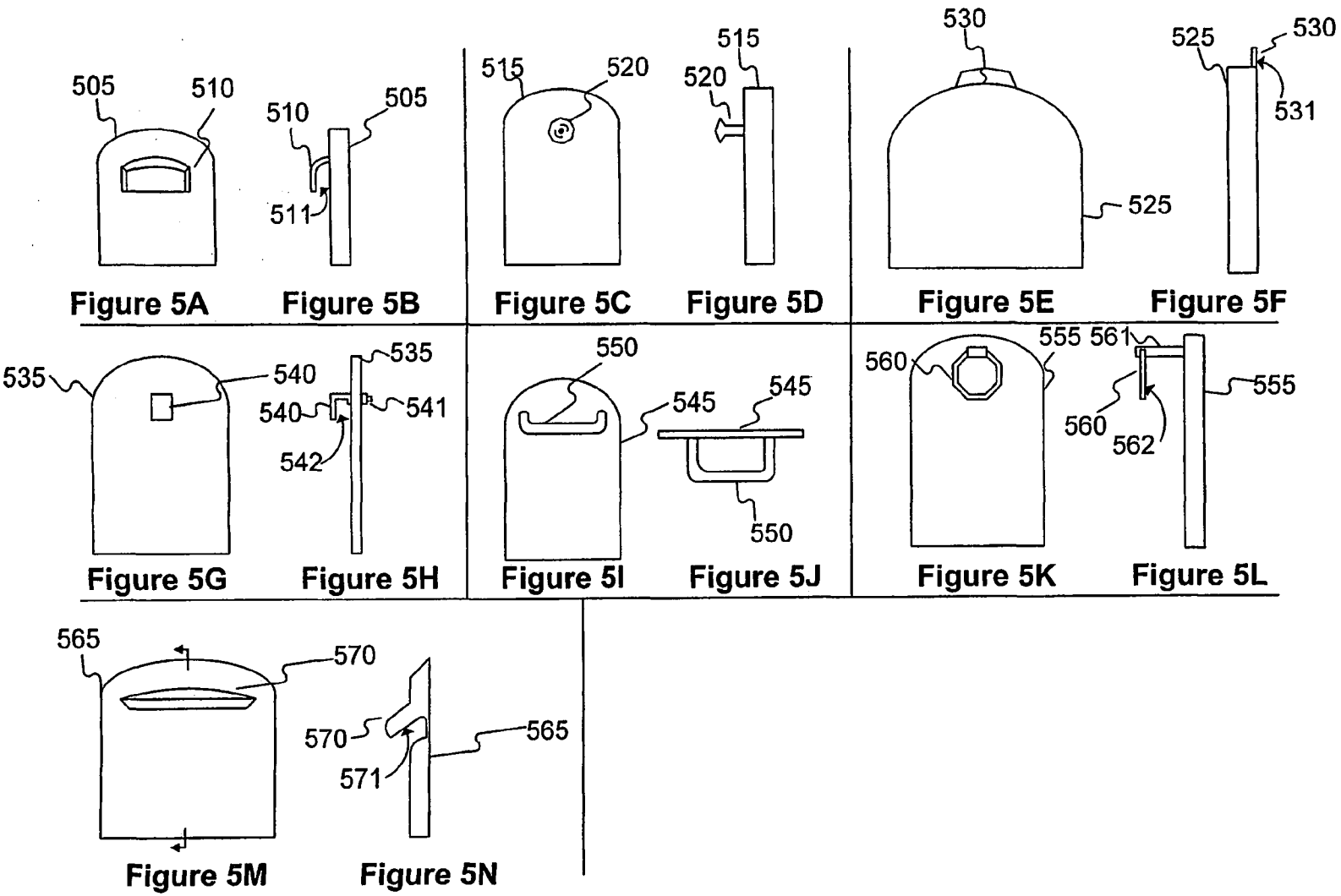
FIG. 5A is a front view of one embodiment of a main door consistent with an exemplary embodiment of the invention, as shown in FIG. 4.
FIG. 5B is a side view of one embodiment of a main door consistent with an exemplary embodiment of the invention, as shown in FIG. 5A.
FIG. 5C is a front view of a second embodiment of a main door consistent with an exemplary embodiment of the invention, as shown in FIG. 4.
FIG. 5D is a side view of a second embodiment of a main door consistent with an exemplary embodiment of the invention, as shown in FIG. 5C.
FIG. 5E is a front view of a third embodiment of a main door consistent with an exemplary embodiment of the invention, as shown in FIG. 4.
FIG. 5F is a side view of a third embodiment of a main door consistent with an exemplary embodiment of the invention, as shown in FIG. 5E.
FIG. 5G is a front view of a fourth embodiment of a main door consistent with an exemplary embodiment of the invention, as shown in FIG. 4.
FIG. 5H is a side view of a fourth embodiment of a main door consistent with an exemplary embodiment of the invention, as shown in FIG. 5G.
FIG. 5I is a front view of a fifth embodiment of a main door consistent with an exemplary embodiment of the invention, as shown in FIG. 4.
FIG. 5J is a top view of a fifth embodiment of a main door consistent with an exemplary embodiment of the invention, as shown in FIG. 5I.
FIG. 5K is a front view of a sixth embodiment of a main door consistent with an exemplary embodiment of the invention, as shown in FIG. 4.
FIG. 5L is a side view of a sixth embodiment of a main door consistent with an exemplary embodiment of the invention, as shown in FIG. 5K.
FIG. 5M is a front view of a seventh embodiment of a main door consistent with an exemplary embodiment of the invention, as shown in FIG. 4.
FIG. 5N is a side view of a seventh embodiment of a main door consistent with an exemplary embodiment of the invention, as shown in FIG. 5M.

FIG. 5A is a front view of one embodiment of a main door consistent with an exemplary embodiment of the invention, as shown in FIG. 4. FIG. 5B is a side view of one embodiment of a main door consistent with an exemplary embodiment of the invention, as shown in FIG. 5A. As shown in FIGS. 5A-5B, main door 505 includes a handle 510. In this implementation, handle 510 comprises a J-shaped structure. To open door 505, an individual would grasp a rear face 511 of handle 510 and pull downward and outward. This implementation is merely exemplary, and other implementations may also be used.

FIG. 5C is a front view of a second embodiment of a main door consistent with an exemplary embodiment of the invention, as shown in FIG. 4. FIG. 5D is a side view of a second embodiment of a main door consistent with an exemplary embodiment of the invention, as shown in FIG. 5C. As shown in FIGS. 5C-5D, main door 515 includes a handle 520. In this implementation, handle 520 comprises a knob. To open door 515, an individual would grasp knob 520 and pull downward and outward. This implementation is merely exemplary, and other implementations may also be used.

FIG. 5E is a front view of a third embodiment of a main door consistent with an exemplary embodiment of the invention, as shown in FIG. 4. FIG. 5F is a side view of a third embodiment of a main door consistent with an exemplary embodiment of the invention, as shown in FIG. 5E. As shown in FIGS. 5E-5F, main door 525 includes a handle 530. In this implementation, handle 530 comprises a tab located at the top of door 530. To open door 530, an individual would grasp a rear face 531 of handle 530 and pull downward and outward. This implementation is merely exemplary, and other implementations may also be used.

FIG. 5G is a front view of a fourth embodiment of a main door consistent with an exemplary embodiment of the invention, as shown in FIG. 4. FIG. 5H is a side view of a fourth embodiment of a main door consistent with an exemplary embodiment of the invention, as shown in FIG. 5G. As shown in FIGS. 5G-5H, main door 535 includes a handle 540. In this implementation, handle 540 comprises an L-shaped structure, which is attached to door 535 by nut 541. To open door 535, an individual would grasp a rear face 542 of handle 540 and pull downward and outward. This implementation is merely exemplary, and other implementations may also be used.

FIG. 5I is a front view of a fifth embodiment of a main door consistent with an exemplary embodiment of the invention, as shown in FIG. 4. FIG. 5J is a top view of a fifth embodiment of a main door consistent with an exemplary embodiment of the invention, as shown in FIG. 5I. As shown in FIGS. 5I-5J, main door 545 includes a handle 550. In this implementation, handle 550 comprises a U-shaped structure. To open door 545, an individual would grasp handle 550 and pull downward and outward. This implementation is merely exemplary, and other implementations may also be used.

FIG. 5K is a front view of a sixth embodiment of a main door consistent with an exemplary embodiment of the invention, as shown in FIG. 4. FIG. 5L is a side view of a sixth embodiment of a main door consistent with an exemplary embodiment of the invention, as shown in FIG. 5K. As shown in FIGS. 5K-5L, main door 555 includes a handle 560. In this implementation, handle 560 comprises a bar 561 and a ring 562. To open door 555, an individual would grasp ring 562 and pull downward and outward. This implementation is merely exemplary, and other implementations may also be used.

FIG. 5M is a front view of a seventh embodiment of a main door consistent with an exemplary embodiment of the invention, as shown in FIG. 4. FIG. 5N is a side view of a seventh embodiment of a main door consistent with an exemplary embodiment of the invention, as shown in FIG. 5M. As shown in FIGS. 5M-5N, main door 565 includes a handle 570. In this implementation, handle 570 comprises a curved protrusion from door 565. To open door 565, an individual would grasp an underside 571 of handle 570 and pull downward and outward. This implementation is merely exemplary, and other implementations may also be used.

Figures 6A, 6B, 6C:
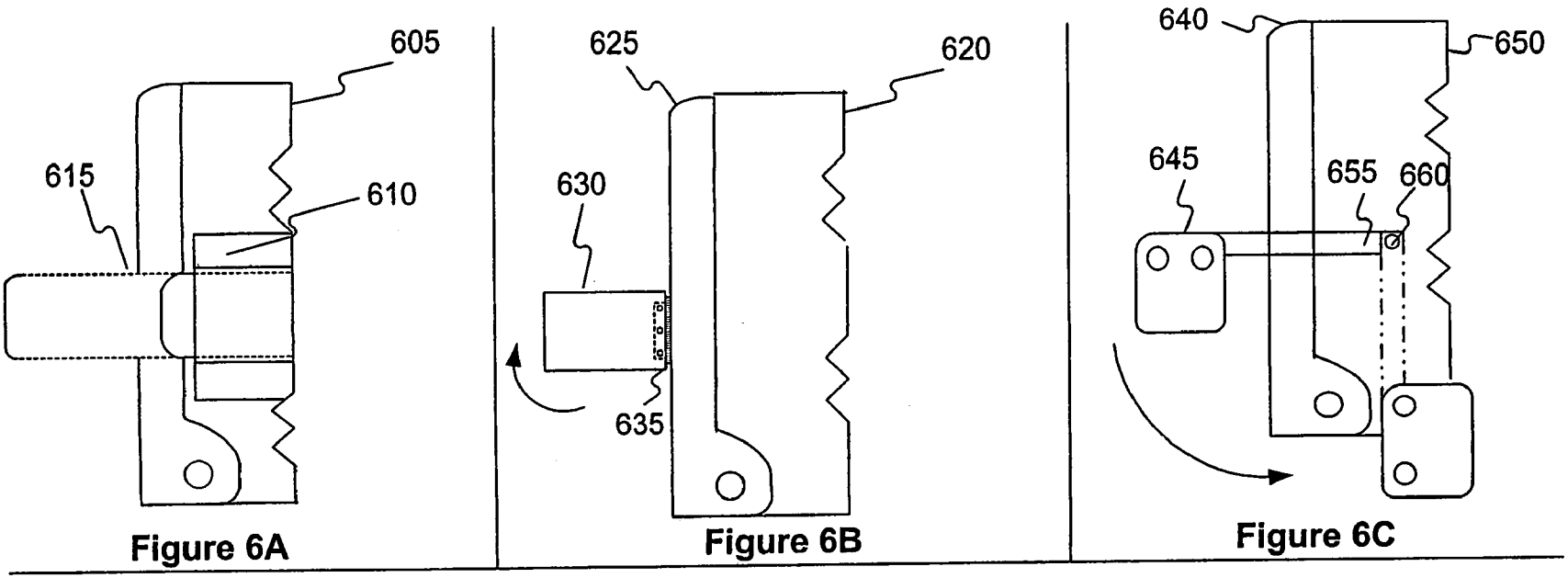
FIG. 6A is a side view of one embodiment of an outgoing mail flag consistent with an exemplary embodiment of the invention, as shown in FIG. 4.
FIG. 6B is a side view of a second embodiment of an outgoing mail flag consistent with an exemplary embodiment of the invention, as shown in FIG. 4.
FIG. 6C is a side view of a third embodiment of an outgoing mail flag consistent with an exemplary embodiment of the invention, as shown in FIG. 4.

FIG. 6A is a side view of one embodiment of an outgoing mail flag consistent with an exemplary embodiment of the invention, as shown in FIG. 4. As shown in FIG. 6A, mail flag 615 is attached to the side of housing 605 and slides horizontally in slot 610. Mail flag 615 extends outward from housing 605 to indicate the presence of outgoing mail and stays in slot 610 to indicate the absence of outgoing mail. Mail flag 615 may be extended and retracted manually or automatically. This implementation is merely exemplary, and other implementations may also be used.

FIG. 6B is a side view of a second embodiment of an outgoing mail flag consistent with an exemplary embodiment of the invention, as shown in FIG. 4. As shown in FIG. 6B, mail flag 630 is attached to main door 625, which is attached to housing 620. In this implementation, mail flag 630 is attached to main door 625 by a hinge 635. Mail flag 630 rotates on hinge 635 to indicate the presence or absence of outgoing mail. Mail flag 630 may be rotated manually or automatically. This implementation is merely exemplary, and other implementations may also be used.

FIG. 6C is a side view of a third embodiment of an outgoing mail flag consistent with an exemplary embodiment of the invention, as shown in FIG. 4. As shown in FIG. 6C, mail flag 645 is attached to rod 655. Rod 655 rotates around axis 660, which is attached to housing 650. In this implementation, mail flag 645 is raised to extend beyond main door 640 to indicate the presence of outgoing mail in the UDCBU. Mail flag 645 may be rotated manually or automatically. This implementation is merely exemplary, and other implementations may also be used.

Figure 7A:
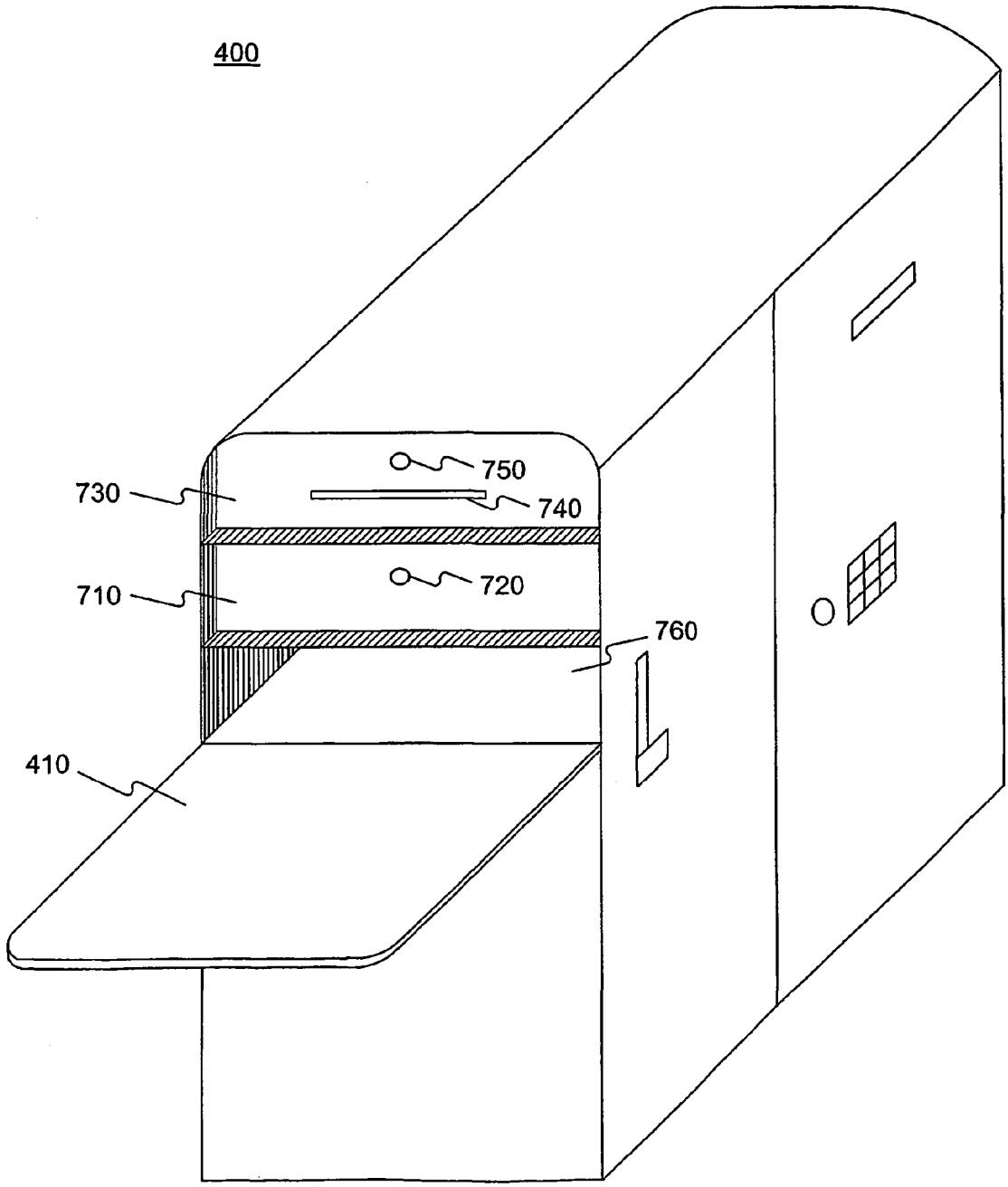
FIG. 7A is a frontal perspective view illustrating a universal delivery and collection box unit with an open main door consistent with an exemplary embodiment of the invention, as shown in FIG. 4.

FIG. 7A is a frontal perspective view illustrating a universal delivery and collection box unit with an open main door consistent with an exemplary embodiment of the invention, as shown in FIG. 4. In this implementation, as shown in FIG. 7A, opening main door 410 of UDCBU 400 reveals an incoming mail door 730, an outgoing mail door 710, and an auxiliary compartment 760. This implementation is merely exemplary, and other implementations may also be used.

Figure 7B:
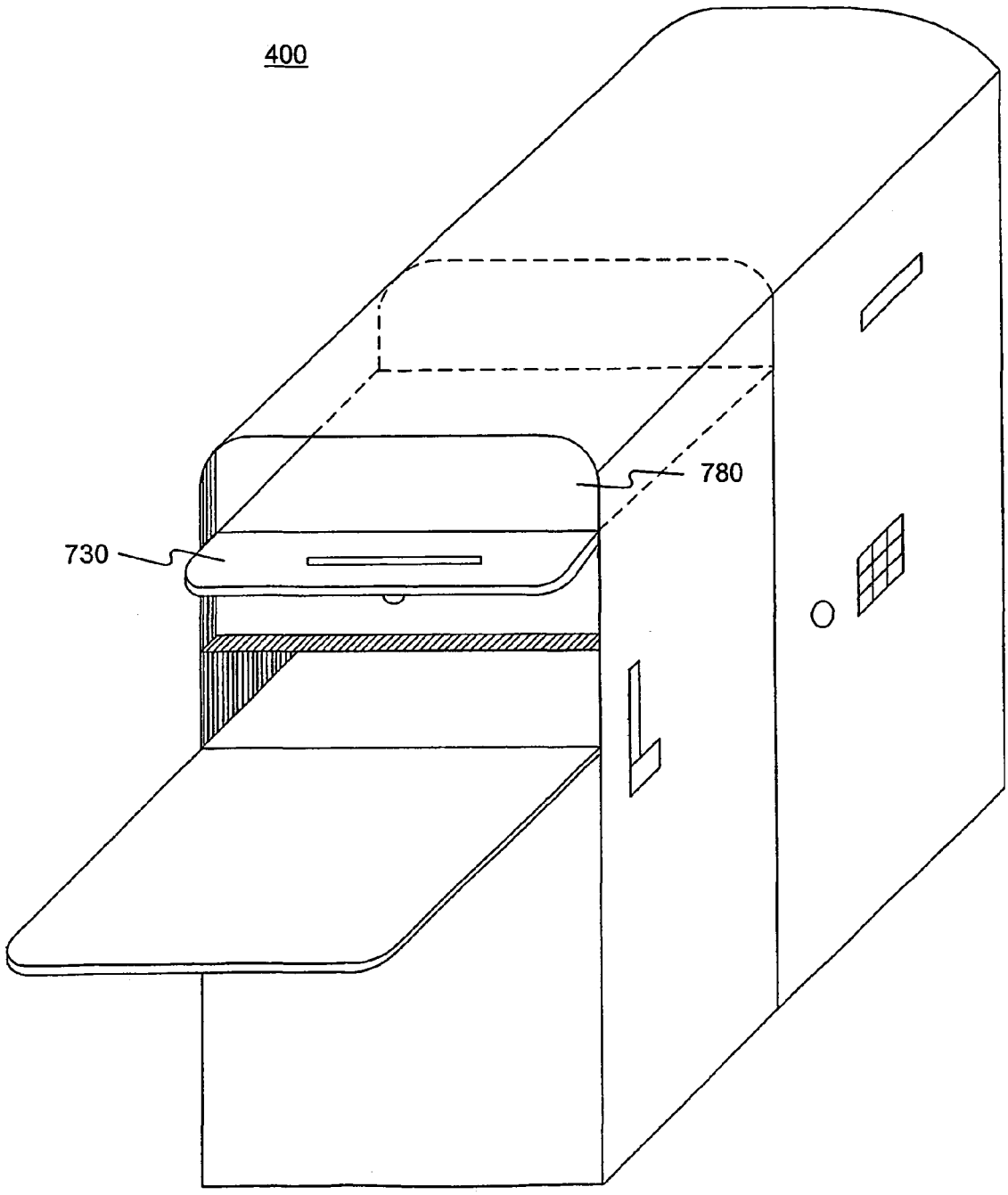
FIG. 7B is a frontal perspective view illustrating a universal delivery and collection box unit with an open main door and open incoming mail door consistent with an exemplary embodiment of the invention, as shown in FIG. 7A.

Incoming mail door 730 provides access to an incoming mail compartment 780 (see FIG. 7B). In one implementation, door latches for incoming mail door 730 will hold incoming mail door 730 closed but will allow easy opening and closing requiring no more than 5 pounds of force. Magnetic latches may also be used in this implementation. These implementations are merely exemplary, and other implementations may also be used.

As shown in FIG. 7A, in one implementation, incoming mail door 730 includes a handle 750 and a slot 740. Handle 750 allows an individual to open incoming mail door 730. Slot 740 allows a mail carrier to place mail into incoming mail compartment 780. In one implementation, the slot will measure a minimum of 1.75 inches high by 10 inches wide. In this implementation, the bottom edge of the slot will be at a height of between 41-45 inches when measured from the road surface. In another implementation, the slot will have a protective flap that operates inward to ensure mail can be inserted in horizontal manner without requiring any additional effort. The design of the mail slot will also preclude opportunities for mail pilfering. In another implementation incoming mail door 730 will include a locking mechanism, such as a PSIN 0910 lock available from USPS-approved sources. These implementations are merely exemplary, and other implementations may also be used.

Figure 7C:
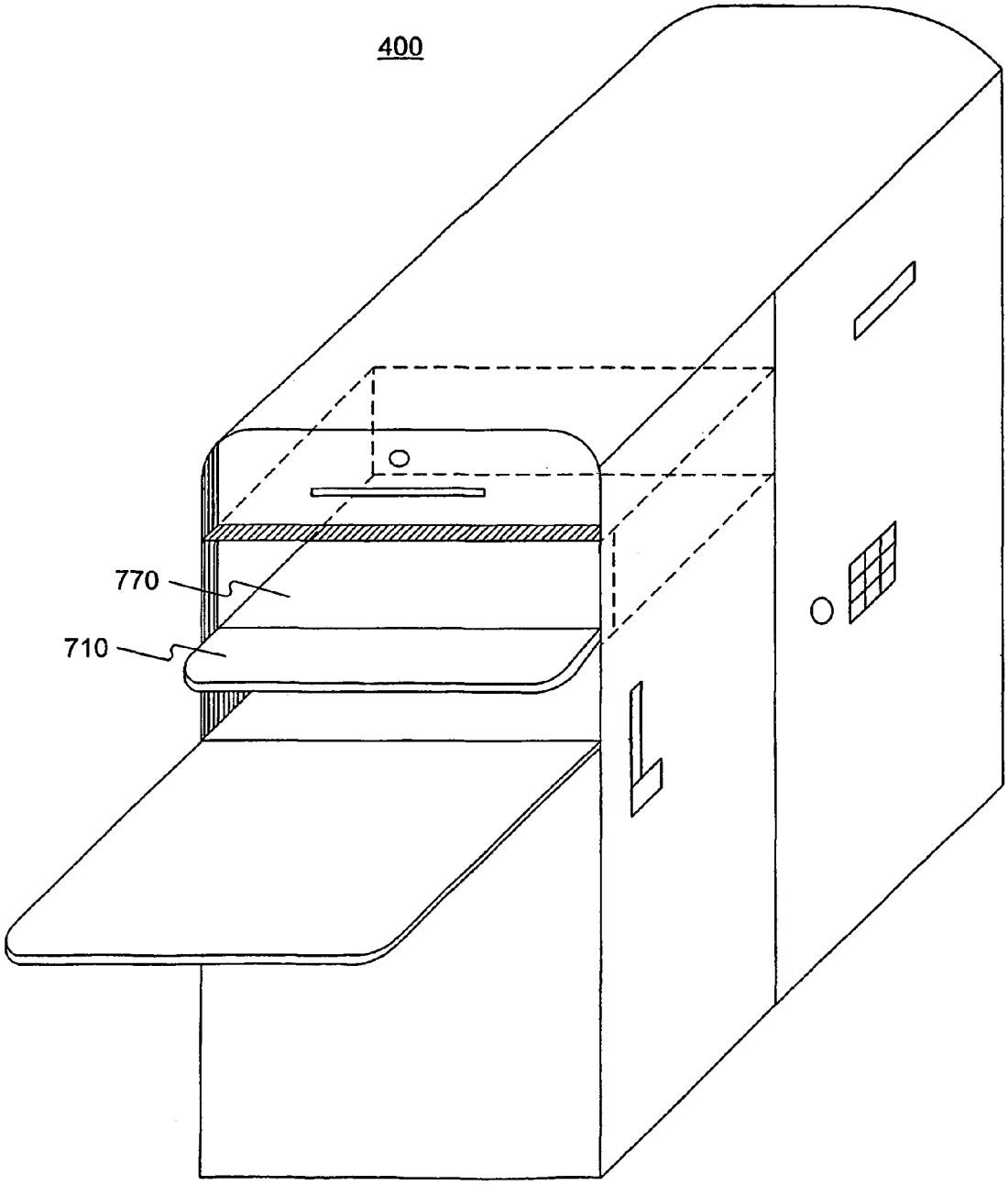
FIG. 7C is a frontal perspective view illustrating a universal delivery and collection box unit with an open main door and open outgoing mail compartment consistent with an exemplary embodiment of the invention, as shown in FIG. 7A.

Outgoing mail door 710 provides access to an outgoing mail compartment 770 (see FIG. 7C). In one implementation, outgoing mail door 710 includes a handle 720. Handle 720 allows an individual to open outgoing mail door 710. This implementation is merely exemplary, and other implementations may also be used.

As shown in FIG. 7A, UDCBU 400 may also include an auxiliary compartment 760. Auxiliary compartment 760 may be used to hold items having a configuration such that it cannot be placed in incoming mail compartment 780, such as newspapers, magazines, and other items as desired. Additional compartments may also be included behind main door 410, if desired.

FIG. 7B is a frontal perspective view illustrating a universal delivery and collection box unit with an open main door and open incoming mail door consistent with an exemplary embodiment of the invention, as shown in FIG. 7A. As shown in FIG. 7B, incoming mail door 730 is opened to reveal an incoming mail compartment 780. Incoming mail compartment 780 holds mail delivered by USPS to an authorized consumer. In one implementation, only the USPS and an authorized consumer would be able to open incoming mail door 730. In this implementation, incoming mail compartment 780 will be a minimum of 12 inches wide by 8 inches high by 15 inches deep. This implementation is merely exemplary, and other implementations may also be used.

FIG. 7C is a frontal perspective view illustrating a universal delivery and collection box unit with an open main door and open outgoing mail compartment consistent with an exemplary embodiment of the invention, as shown in FIG. 7A. As shown in FIG. 7C, outgoing mail door 710 is opened to reveal an outgoing mail compartment 770. Outgoing mail compartment 770 holds mail from the authorized consumer to be picked up by USPS for delivery. In one implementation, outgoing mail compartment 770 will be capable of accommodating more than a dozen standard letters and flats. In another implementation, the floor of outgoing mail compartment 770 will be corrugated or ribbed to ensure that the mail remains dry and does not stick as a result of condensation. This implementation is merely exemplary, and other implementations may also be used.

FIG. 8 is a frontal perspective view illustrating a universal delivery and collection box unit with an open storage door consistent with an exemplary embodiment of the invention, as shown in FIG. 4. As shown in FIG. 8, storage door 460 is opened to reveal storage compartment 810. In one implementation, storage compartment 810 comprises a shelf 830 and a clothing rod 820. This implementation is merely exemplary, and other implementations may also be used.

Shelf 830 is used to store and arrange deliverables in storage compartment 810. In one implementation, shelf 830 may be retractable and/or vertically adjustable to allow for the separation of various parcels. Clothing rod 820 is used to hang clothing. This would permit dry cleaners to deliver to UDCBU 400. In one implementation, clothing rod 820 may be adjustable. These implementations are merely exemplary, and other implementations may also be used.

In another implementation, storage compartment 810 may be capable of holding perishables, refrigerated items and frozen goods. In this implementation, the perishables, refrigerated items and frozen goods, would be able to be held for a period of at least 12 hours. A time/date stamp may be used to indicate the amount of time an item has been in storage compartment 810.

In one implementation, storage compartment 810 may comprise insulation 860 located in the walls of storage compartment 810 to maintain the temperature in storage compartment 810. In another implementation, insulation packs that maintain temperatures for refrigerated or frozen items may be used. In yet another implementation, storage compartment 810 may comprise a temperature control device 850 such as an appropriate heating or cooling element to maintain a predetermined temperature in the storage compartment 810. These implementations are merely exemplary, and other implementations may also be used.

The implementation described in FIGS. 4-8 is primarily designed for a single-family dwelling. However, a UDCBU consistent with the invention could also be designed for multi-family residences or offices. By increasing the size and or number of the compartments, the UDCBU could be designed to accommodate multiple authorized consumers.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A secure container for housing mail and other deliverables comprising:

a watertight housing;

an incoming mail compartment disposed inside the housing;

an outgoing mail compartment disposed inside the housing;

a storage compartment disposed inside the housing;

a main door attached to the housing, wherein the main door provides access to the incoming mail compartment and the outgoing mail compartment and does not provide access to the storage compartment;

a storage door attached to the housing, wherein the storage door provides access to the storage compartment and does not provide access to the incoming mail compartment and outgoing mail compartment;

a sensing device configured to determine delivery information upon placement of a deliverable in the storage compartment;

an electronic memory adapted to store a log of the delivery information; and a communication device configured to communicate the delivery information from the electronic memory to a scanning device, wherein the scanning device includes:

a receiver configured to retrieve the delivery information from the communication device; and a transmitter configured to transmit the delivery information to a designated location.

2. The container of claim 1, wherein the incoming mail compartment comprises:

a door, the door including a slot for receiving mail; and a locking mechanism, wherein the locking mechanism allows an authorized consumer to access the incoming mail compartment.

3. The container of claim 1, wherein the storage compartment includes a bar for hanging clothing.

4. The container of claim 1, wherein the storage compartment is lined at least in part with insulation.

5. The container of claim 4, wherein the storage compartment further comprises:

a temperature control device configured to maintain a predetermined temperature in the storage compartment.

6. The container of claim 1, wherein the main door comprises:

a locking mechanism, wherein the locking mechanism allows only the United States Postal Service and an authorized consumer to open the main door.

7. The container of claim 1, wherein the sensing device includes:

a locking mechanism located in the storage door, wherein the locking mechanism allows only the United States Postal Service, an authorized consumer, and an authorized source of deliveries to open the storage door.

8. The container of claim 7, wherein the locking mechanism comprises:

an electronic lock operated by a keypad located on the storage door.

9. The container of claim 8, wherein the electronic lock is configured to be opened when an access code is entered on the keypad; and the delivery information includes the access code used to open the electronic lock and the time and date the access code is used.

10. The container of claim 1, further comprising:

a deliverables indicator located on the storage door to indicate the presence of a deliverable in the storage compartment.

11. The container of claim 1, wherein the delivery information includes:

the time at which a deliverable is placed in the storage compartment; and the source of the deliverable in the storage compartment.

12. The container of claim 1, further comprising:

an outgoing mail flag located on the exterior of the housing, the flag having a first orientation and a second orientation, the first orientation indicating the presence of mail in the outgoing mail compartment, and the second orientation indicating the absence of mail in the outgoing mail compartment.

13. The container of claim 1, further comprising a second communication device configured to communicate the delivery information to a second designated location.

14. The container of claim 13, wherein the second communication device is a wireless transmitter.

15. A secure container for housing mail and other deliverables comprising:

a watertight housing;

an incoming mail compartment located inside the housing;

an outgoing mail compartment located inside the housing;

an auxiliary mail compartment located inside the housing, the auxiliary compartment configured to accept mail having a configuration such that it cannot be delivered to the incoming mail compartment;

a storage compartment located inside the housing;

a main door attached to the housing, wherein the main door provides access to the incoming mail compartment, the outgoing mail compartment, and the auxiliary mail compartment; and wherein the main door comprises a locking mechanism, wherein the locking mechanism allows only the United States Postal Service and an authorized consumer to open the main door;

a storage door attached to the housing, wherein the storage door provides access to the storage compartment;

a sensing device configured to identify delivery information including the time a deliverable is placed in the storage compartment and the source of the deliverable wherein the sensing device includes a locking mechanism located in the storage door that allows only the United States Postal Service, an authorized consumer, and an authorized source of deliveries to open the storage door;

an electronic memory adapted to store a log of the identified delivery information;

a communication device configured to communicate the delivery information from the electronic memory to a scanning device, wherein the scanning device includes:

a receiver configured to retrieve the delivery information from the communication device; and a transmitter configured to transmit the delivery information to a designated location.

16. The secure container of claim 15, further comprising a second communication device configured to transmit the delivery information to a predetermined recipient.

17. The secure container of claim 15 further comprising:

an outgoing mail flag located on the exterior of the housing, wherein the outgoing mail flag is movable between a first position and a second position, the first position indicating the presence of mail in the outgoing mail compartment, and the second position indicating the absence of mail in the outgoing mail compartment.

18. The container of claim 15, wherein the wherein the scanning device is an infrared scanning device.

19. A system for receiving deliverables and communicating delivery information to an intended recipient, comprising:

a receptacle configured to receive deliverables, the receptacle including a first compartment for receiving postal deliverables and a second compartment for receiving deliverables from authorized non-postal sources;

means for sensing when non-postal deliverables are received in the second compartment and for identifying associated delivery information;

means for electronically storing the delivery information and transmitting the delivery information to a designated location;

means for receiving transmitted delivery information;

means for storing transmitted delivery information;

means for sorting the delivery information based on the identity of the source of the non-postal deliverables in the second compartment; and means for calculating an access fee based on the number of times the source of the non-postal deliverables placed a non-postal deliverable in the second compartment.

20. A system for receiving deliverables and communicating delivery information to an intended recipient, comprising:

a receptacle configured to receive deliverables, the receptacle including a first compartment for receiving postal deliverables and a second compartment for receiving deliverables from authorized non-postal sources;

means for sensing when non-postal deliverables are received in the second compartment and for identifying associated delivery information;

means for electronically storing the delivery information and transmitting the delivery information to a designated location; and a communication device configured to communicate the delivery information from the means for electronically storing the delivery information to a scanning device, wherein the scanning device includes a receiver configured to retrieve the delivery information from the communication device.

21. The system of claim 20, wherein the means for sensing includes a timing device configured to identify the time of delivery.

22. The system of claim 21, wherein the sensing means includes an access control mechanism configured to accept a code identifying the source of the deliverable.

23. The system of claim 21, wherein the means for sensing includes an identification device configured to identify the source of the non-postal deliverables in the second compartment.

24. The system of claim 20, further comprising a database located remote from the receptacle for receiving and storing the delivery information and wherein the scanning device further includes a transmitter configured to transmit the delivery information to the database.

25. The system of claim 20, wherein the scanning device is a wireless electronic device having a memory and a display.

26. The system of claim 20, wherein the scanning device is an infrared scanning device.

27. The system of claim 20, further comprising means for indicating the presence of a deliverable in the second compartment.

28. The system of claim 20, wherein the delivery information is transmitted periodically.

29. The system of claim 20, wherein the delivery information is transmitted in real-time.

30. A method for monitoring delivery of items to a plurality of receptacles at different locations, the method comprising:

providing a secure receptacle to a plurality of consumers, the secure receptacle including at least two secured storage compartments configured to accept delivered items, wherein at least one secured storage compartment is configured to receive postal deliverables and at least one storage compartment is configured to receive deliverables from authorized non-postal sources;

authorizing at least one non-postal source of deliverable items to have access to the non-postal storage compartments of each receptacle;

monitoring usage of the secured non-postal storage compartment to identify when a delivered item has been received and identifying the authorized source of the delivered item; and assessing a fee against the authorized source.

31. The method of claim 30, wherein the fee is assessed for each delivered item.

32. The method of claim 30, wherein the fee is periodically assessed for access to the secured container over a predetermined time period.

33. The method of claim 30, wherein a plurality of sources of deliverable items are authorized and each such source is provided with a unique identification necessary to obtain access to the secured storage container.

34. A secure container for housing mail and other deliverables comprising:

a watertight housing;

an incoming mail compartment disposed inside the housing;

an outgoing mail compartment disposed inside the housing;

a storage compartment disposed inside the housing;

a main door attached to the housing, wherein the main door provides access to the incoming mail compartment and the outgoing mail compartment;

a storage door attached to the housing, wherein the storage door provides access to the storage compartment;

a sensing device configured to determine delivery information upon placement of a deliverable in the storage compartment;

an electronic memory adapted to store a log of the delivery information;

a communication device configured to communicate the delivery information from the electronic memory to an infrared scanning device, wherein the scanning device includes:

a receiver configured to retrieve the delivery information from the communication device; and a transmitter configured to transmit the delivery information to a designated location.

35. The container of claim 34, wherein the incoming mail compartment comprises:

a door, the door including a slot for receiving mail; and a locking mechanism, wherein the locking mechanism allows an authorized consumer to access the incoming mail compartment.

36. The container of claim 34, wherein the storage compartment includes a bar for hanging clothing.

37. The container of claim 34, wherein the storage compartment is lined at least in part with insulation.

38. The container of claim 37, wherein the storage compartment further comprises:

a temperature control device configured to maintain a predetermined temperature in the storage compartment.

39. The container of claim 34, wherein the main door comprises:

a locking mechanism, wherein the locking mechanism allows only the United States Postal Service and an authorized consumer to open the main door.

40. The container of claim 34, wherein the sensing device includes:

a locking mechanism located on the storage door, wherein the locking mechanism allows only the United States Postal Service, an authorized consumer, and an authorized source of deliveries to open the storage door.

41. The container of claim 40, wherein the locking mechanism comprises:

an electronic lock operated by a keypad located on the storage door.

42. The container of claim 41, wherein the electronic lock is configured to be opened when an access code is entered on the keypad; and the delivery information includes the access code used to open the electronic lock and the time and date the access code is used.

43. The container of claim 34, further comprising:

a deliverables indicator located on the storage door to indicate the presence of a deliverable in the storage compartment.

44. The container of claim 34, wherein the delivery information includes:

the time at which a deliverable is placed in the storage compartment; and the source of the deliverable in the storage compartment.

45. The container of claim 34, further comprising:

an outgoing mail flag located on the exterior of the housing, the flag having a first orientation and a second orientation, the first orientation indicating the presence of mail in the outgoing mail compartment, and the second orientation indicating the absence of mail in the outgoing mail compartment.

46. The container of claim 34, further comprising a second communication device configured to communicate the delivery information to a second designated location.

47. The container of claim 46, wherein the second communication device is a wireless transmitter.

* * * * *

UNITED STATES PATENT AND TRADEMARK OFFICE

CERTIFICATE OF CORRECTION

PATENT NO. : 7,337,944 B2
APPLICATION NO. : 10/468364
DATED : March 4, 2008
INVENTOR(S) : Rodney C. Devar It is certified that error appears in the above-identified patent and that said Letters Patent is hereby corrected as shown below:

Claim 18, col. 15, line 52, delete second instance of "wherein the".

Signed and Sealed this

Tenth Day of June, 2008

JON W. DUDAS
*Director of the United States Patent and Trademark Office*